United States Patent [19]

Dustin

[11] Patent Number: 4,592,333

[45] Date of Patent: Jun. 3, 1986

[54] CONVERTIBLE VENTILATION SYSTEM FOR OVEN

[75] Inventor: Terry C. Dustin, Southgate, Calif.

[73] Assignee: Masco Building Products Corp., Taylor, Mich.

[21] Appl. No.: 751,265

[22] Filed: Jul. 2, 1985

[51] Int. Cl.[4] ..... F24C 15/32

[52] U.S. Cl. ..... 126/21 R; 126/299 R

[58] Field of Search ..... 126/299 R, 299 D, 299 F, 126/299 C, 312, 21 A, 21 R; 98/115.1, 115.3, 115.4; 55/DIG. 36

[56] References Cited

U.S. PATENT DOCUMENTS

| | | | |
|---|---|---|---|
| 2,634,718 | 4/1953 | Williams | 126/299 R |
| 3,741,194 | 6/1973 | Herron | 126/21 R |
| 4,114,589 | 9/1978 | Berlik et al. | 126/21 R |
| 4,143,646 | 3/1979 | Sampsel | 126/299 R |

*Primary Examiner*—James C. Yeung

*Attorney, Agent, or Firm*—Edward A. Sokolski

[57] ABSTRACT

An oven has a cooling system which includes air channels which run along the top rear and bottom walls of the oven compartments. First and second channels are provided, the first channel being used principally for providing air flow for outdoor venting, the first and second channels being employed for indoor venting which occurs through an outlet at the very bottom of the lower oven compartment. The oven can rapidly and easily be converted for outdoor venting by removing a cover attached to a top portion of the oven system and installing an outdoor venting duct. A blower is used to circulate air for both indoor and outdoor venting.

5 Claims, 5 Drawing Figures

CONVERTIBLE VENTILATION SYSTEM FOR OVEN

This invention relates to cooking ovens, and more particularly to a venting system for such an oven which is readily convertible from indoor venting operation to outdoor venting operation.

There are many oven installations in which it is impossible to provide suitable outdoor venting for ovens, particularly in high rise apartment complexes. There are also many situations where outdoor venting can readily be obtained and is desirable by the end user. Therefore, there is a need for an oven which can readily be converted by the installer for either indoor or outdoor venting, depending upon the particular requirements of the end user. Such a convertible oven is described in U.S. Pat. No. 4,114,589 issued 9/19/78 to Berlik, et al. While this oven provides means for converting the venting between indoor and outdoor venting arrangements, the indoor venting has distinct shortcomings in that the indoor venting is accomplished directly above the cooking compartments which tends to lead to the deposit of cooking soil on the front frame and window of the oven. Further, in cooking foods of high moisture content, water vapor exits the oven and condenses in the ambient atmosphere, and tends to drip onto the door window as well as the cooking controls so as to make it difficult to see into the oven and to view the controls.

The device of the present invention is an improvement over prior art devices of the type just mentioned, in that it provides indoor venting from the very bottom portion of an oven assembly where condensed vapor and soilant is less likely to accumulate on the oven doors and their windows. A filter and catalyst are employed in the flow path out of the oven compartments, so as to filter out moisture and soil material, this flow pattern being established by a blower located at the top of the oven assembly.

The device of the present invention employs a first venting channel running along the upper oven compartment at the rear, top and bottom thereof and the lower oven compartment at the top and rear thereof, and a second venting channel running along the first venting channel at the rear thereof and along the bottom of the lower oven compartment. For indoor venting, air is circulated by the blower from the ovens around the first channel to the top of the oven assembly, and then down along the rear portion of the second channel to the bottom portion of this channel from where it is vented out into the ambient atmosphere. For outdoor venting, the air is drawn by the blower out of each of the oven compartments and through the first channel to the upper portion of the oven assembly and exited through an outdoor vent connected to the oven through an aperture, which for indoor venting is covered.

It is therefore an object of this invention to provide an improved oven, convertible for either indoor or outdoor venting in which the indoor venting is accomplished at the bottom of the oven assembly.

It is a further object of this invention to minimize the deposit of soil on an oven during the indoor venting thereof.

Other objects of the invention will become apparent as the description proceeds in connection with the accompanying drawings of which:

Figure 1:
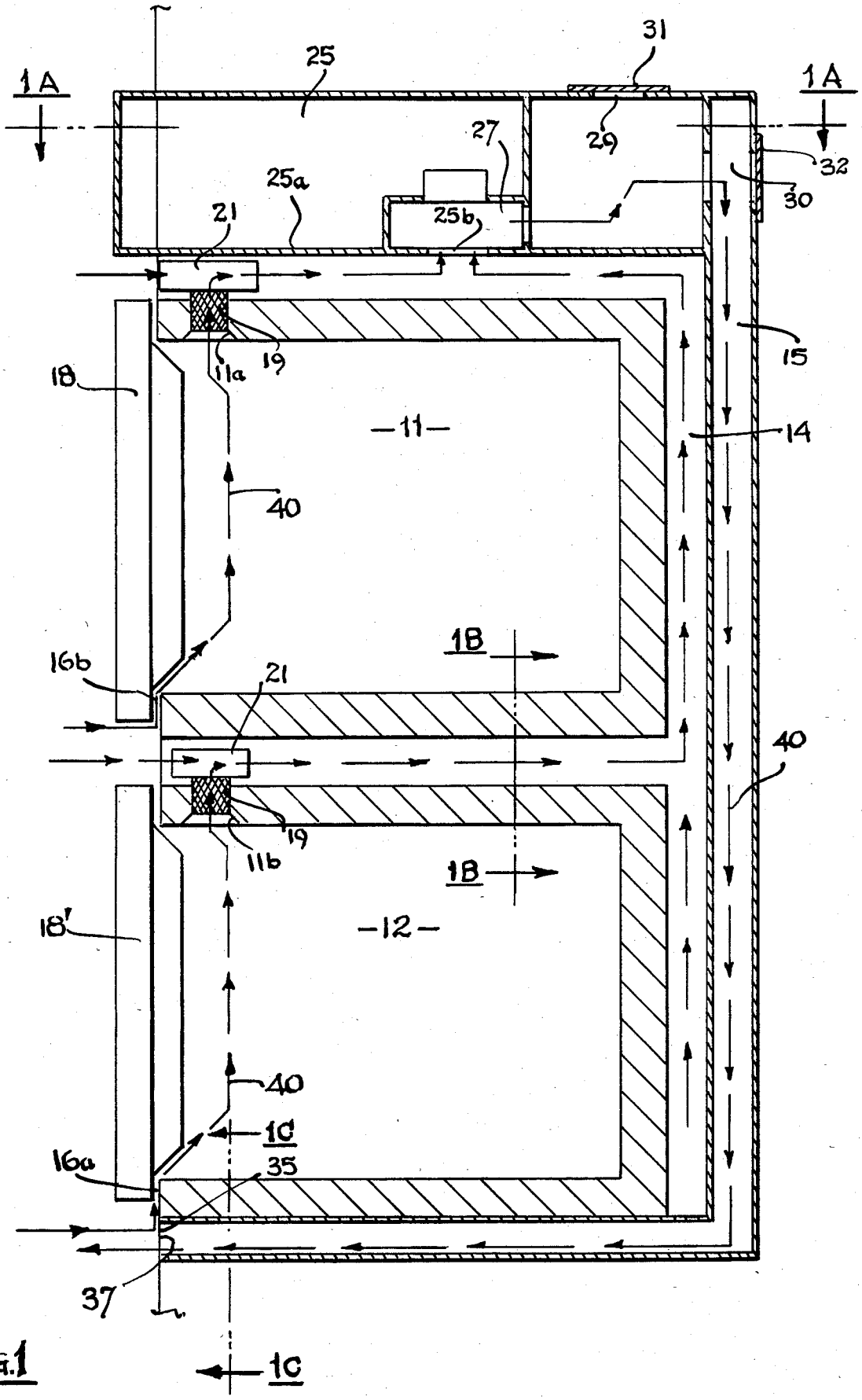
FIG. 1 is a cross sectional view in elevation illustrating a preferred embodiment of the oven of the invention as operated for indoor venting.
Figure 1A:
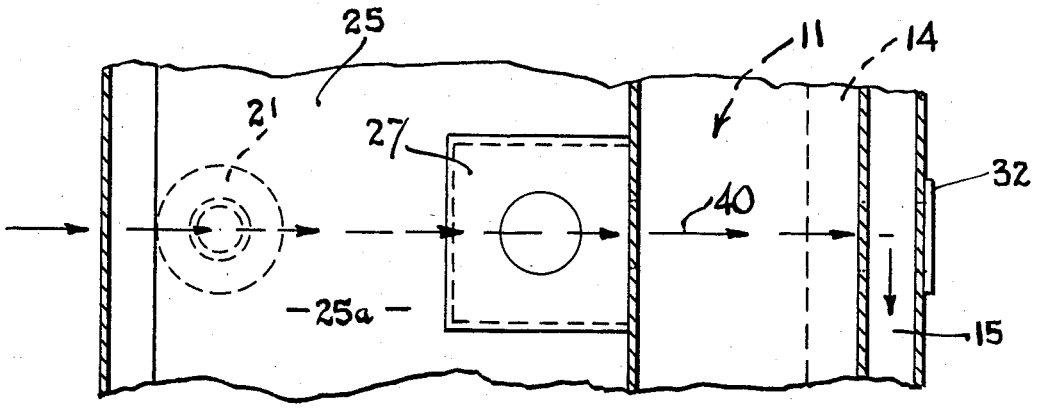
FIG. 1A is a cross sectional view taken along the plane indicated by 1A—1A in FIG. 1.
Figure 1B:
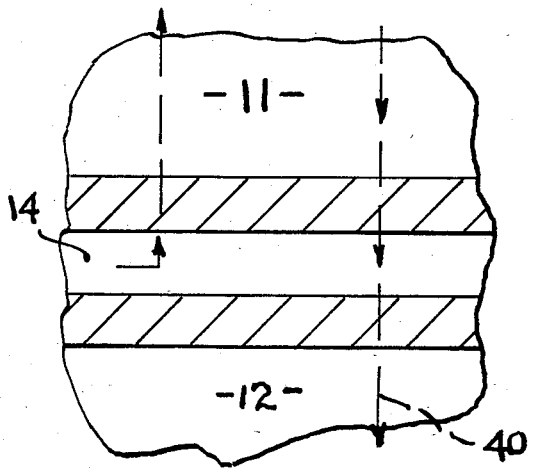
FIG. 1B is a cross sectional view taken along a plane indicated by 1B—1B in FIG. 1.
Figure 1C:
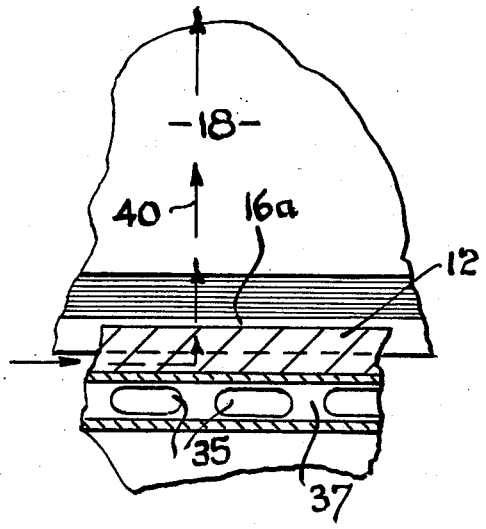
FIG. 1C is a cross sectional view taken of the plane indicated by 1C—1C in FIG. 1.

Referring now to FIGS. 1, 1A, 1B, and 1C, a preferred embodiment of the invention installed for indoor venting is illustrated. The oven has upper and lower oven compartments 11 and 12. A first venting channel 14 is provided along the top rear and in the case of compartment 11 the bottom of the oven compartments. A second venting channel 15 is provided outboard of and along the rear of the venting channel 14 and along the bottom of oven compartment 12. Slits **16*a* and 16*b* are provided along the bottom edges of oven doors 18 and 19, respectively for enabling flow of ambient air into the oven. Outlets 11*a* and 11*b* are provided for the upper and lower ovens, respectively, a catalytic oxidation unit 19 being installed in each of these outlets. The catalytic oxidation units 19 convert any carbon monoxide in the combustion gases to carbon dioxide. A filter 21 is provided in series with each of oxdiation units 19. These filters remove soil from the flow of gases into channel 14**.

A compartment 25 is provided at the top of the oven assembly, this compartment containing a blower unit 27 which is mounted along the bottom wall **25*a* of the compartment. An aperture 25*b* is formed in wall 25*a* to provide fluid communication between the blower and channel 14. Venting apertures 29 and 30 are provided in the top and rear walls respectively of compartment 25, each of these apertures being closed off by a respective cover 31 and 32 which may be attached to the oven assembly by means of machine screws. Outlet venting apertures 35 are provided in the bottom front wall 37 of channel 15 for venting the air stream. The venting operation of the ovens is indicated by the flow arrows 40. As can be seen, ambient air enters the ovens through slits 16*a* and 16*b*, and flows through the oven compartments and the catalytic converters and filters into channel 14, then through blower 27 and from the blower, down through channel 15, and out through venting apertures 35 into the ambient atmosphere. Blower 27** is turned on manually during operation of the oven, and provides circulation as indicated by the flow arrows throughout such operation.

Figure 2:
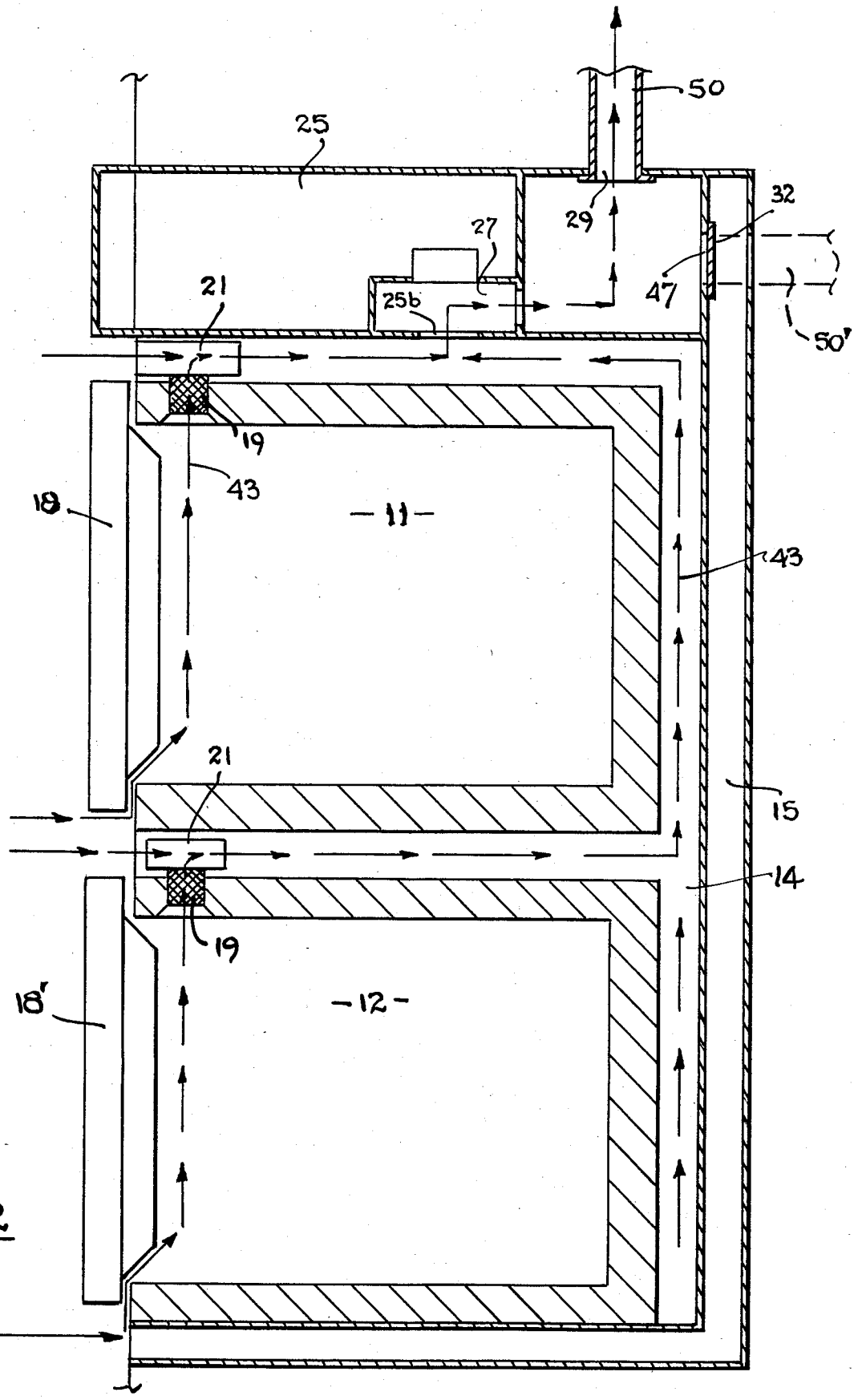
FIG. 2 is a cross sectional view in elevation of the preferred embodiment of the oven of the invention being operated for outdoor venting.

Referring now to FIG. 2, the oven is shown connected for outdoor venting. With such operation, cover 32 is placed over venting aperture 47 so as to close off channel 15 from fluid communication with the venting stream. Cover 31 (FIG. 1) is removed, and a venting duct 50 installed in venting aperture 29 by means of machine screws, this duct carrying the exhaust air to the outside. As for the previous embodiment, the air stream is induced by blower 27, which pulls the air stream upwardly as indicated by flow arrows 43.

If venting is desired from the rear, the venting duct 50 may be mounted over aperture 47 as shown in dotted outline 50, with cover 31 being left in place and cover 32 being removed.

As can be seen, the oven of the present invention can readily be converted from indoor to outdoor operation and vice versa. For indoor operation, the exhaust air is fed out from the bottom of the oven assembly where soil and moisture can dissipate in the ambient atmosphere without accumulating on the oven.

While the invention has been described and illustrated in detail, it is to be clearly understood that this is intended by way of illustration example only and is not to be taken by way of limitation. The spirit and scope of this invention being limited only by the terms of the following claims:

I claim:

1. In an oven system having upper and lower oven compartments, the improvement being means for providing a first mode of operation wherein the oven compartments are vented into the indoor ambient atmosphere and a second mode of operation wherein the oven compartments are vented to the outdoor comprising:

a first venting channel running along the upper oven compartment at the rear top and bottom thereof and the lower oven compartment at the top and rear thereof;

a second venting channel running along the rear portion of the first venting channel and the bottom of the lower oven compartment;

means for venting said oven compartments into said first venting channel;

means for venting one end of said second venting channel to the indoor ambient atmosphere, said venting means being located below the lower oven compartment;

means for inducing a flow of air in said venting channels;

means in said first mode of operation for interconnecting said first and second channels and preventing fluid communications to the outdoor, said air flow inducing means effecting an air flow from said oven compartments through said first channel to said second channel and out into the indoor ambient atmosphere through said venting means below the lower oven compartment; and means in said second mode of operation for preventing fluid communications between said first and second channels and effecting fluid communications between said first venting channel and the outdoors, said air flow inducing means effecting an air flow from said oven compartments through first channel to the outdoors.

2. The oven system of claim 1 wherein said means for inducing a flow of air in said venting channels comprises a blower.

3. The oven system of claim 2 wherein said blower is installed above said upper oven compartment in fluid communication with said first venting channel.

4. The oven system of claim 1 wherein the means for interconnecting said first and second channels in said first mode of operation comprises aperture means formed between said first and second venting channels, said means for preventing fluid communications between said first and second channels in said second mode of operation comprising a cover plate placed over said aperture means.

5. The oven system of claim 1 wherein said means in said second mode of operation for effecting fluid communication between the first venting channel and the outdoors comprises a venting duct connected in fluid communications with said second channel.

* * * * *